US007565900B2

(12) United States Patent
Sato et al.

(10) Patent No.: US 7,565,900 B2
(45) Date of Patent: Jul. 28, 2009

(54) FUEL PROPERTY DETERMINING APPARATUS, LEAKAGE DETECTING APPARATUS, AND INJECTION CONTROL APPARATUS

(75) Inventors: Kazuki Sato, Ichinomiya (JP); Tomoaki Nakano, Nagoya (JP)

(73) Assignee: DENSO Corporation, Kariya (JP)

( * ) Notice: Subject to any disclaimer, the term of this patent is extended or adjusted under 35 U.S.C. 154(b) by 129 days.

(21) Appl. No.: 11/711,901

(22) Filed: Feb. 28, 2007

(65) Prior Publication Data

US 2007/0246025 A1 Oct. 25, 2007

(30) Foreign Application Priority Data

Feb. 28, 2006 (JP) ..... 2006-053469

(51) Int. Cl.
*F02M 37/20* (2006.01)
*F02M 33/02* (2006.01)

(52) U.S. Cl. ..... 123/516; 123/520; 123/1 A

(58) Field of Classification Search ..... 123/516, 123/518, 519, 520, 1 A; 96/108, 111, 112, 96/113

See application file for complete search history.

(56) References Cited

U.S. PATENT DOCUMENTS 5,111,796 A * 5/1992 Ogita ..... 123/520
5,203,870 A * 4/1993 Kayanuma et al. ..... 123/198 D
5,343,760 A * 9/1994 Sultan et al. ..... 73/861.04
5,560,347 A * 10/1996 Reddy et al. ..... 123/520
6,047,688 A * 4/2000 Duty et al. ..... 123/520
6,109,225 A * 8/2000 Ogita et al. ..... 123/90.15
6,119,662 A * 9/2000 Duty et al. ..... 123/520
6,196,203 B1 * 3/2001 Grieve et al. ..... 123/520
6,338,336 B1 * 1/2002 Iida ..... 123/674
6,829,555 B2 * 12/2004 Penschuck et al. ..... 702/130
6,971,375 B2 12/2005 Amano et al.
7,059,313 B2 * 6/2006 Lippa ..... 123/685
7,165,447 B2 * 1/2007 Miyahara et al. ..... 73/114.39
7,389,769 B2 * 6/2008 Amano et al. ..... 123/520
2003/0005915 A1 * 1/2003 Mitsutani ..... 123/674
2005/0240336 A1 * 10/2005 Reddy ..... 701/103
2006/0042605 A1 3/2006 Amano et al.

FOREIGN PATENT DOCUMENTS

JP 07-269419 10/1995

* cited by examiner

*Primary Examiner*—Thomas N Moulis
(74) *Attorney, Agent, or Firm*—Nixon & Vanderhye P.C.

(57) ABSTRACT

A fuel property determining apparatus is provided to a fuel vapor treatment apparatus. The fuel vapor treatment apparatus controls purging of mixture containing fuel vapor, which is generated in a fuel tank and temporarily adsorbed in a canister, into an intake pipe of an internal combustion engine when the internal combustion engine operates. The fuel vapor treatment apparatus controls the purging on the basis of a fuel vapor state of the mixture. The fuel property determining apparatus includes a fuel vapor state determining unit for determining the fuel vapor state The fuel property determining apparatus further includes a fuel property determining unit for determining a fuel property, which is relevant to volatility of fuel, on the basis of change in the fuel vapor state, the change in the fuel vapor state being caused by the purging.

23 Claims, 6 Drawing Sheets

FUEL PROPERTY DETERMINING APPARATUS, LEAKAGE DETECTING APPARATUS, AND INJECTION CONTROL APPARATUS

CROSS REFERENCE TO RELATED APPLICATIONS

This application is based on and incorporates herein by reference Japanese Patent Application No. 2006-53469 filed on Feb. 28, 2006.

FIELD OF THE INVENTION

The present invention relates to a fuel property determining apparatus. The present invention further relates to a leakage detecting apparatus having the fuel property determining apparatus. The present invention further relates to an injection control apparatus having the fuel property determining apparatus. The present invention further relates to methods respectively for determining fuel property, detecting leakage in a fuel vapor treatment apparatus, and controlling fuel injection.

BACKGROUND OF THE INVENTION

Generally, an internal combustion engine for a vehicle includes a fuel vapor treatment apparatus. The fuel vapor treatment apparatus restricts fuel vapor, which is produced in a fuel tank, from diffusing into the atmosphere. Fuel vapor is introduced from the fuel tank into a canister of the fuel vapor treatment apparatus. The canister accommodates an adsorbent to temporarily adsorb the fuel vapor into the adsorbent. The fuel vapor adsorbed into the adsorbent is desorbed from the adsorbent by negative pressure in the intake pipe of the engine, so that fuel vapor is purged into the intake pipe through a purge pipe in an engine operation. Fuel vapor is desorbed from the adsorbent, so that the absorptivity of the adsorbent recovers.

When fuel vapor is being purged from the canister, the air/fuel ratio of mixture introduced into the engine needs to be controlled at a target air/fuel ratio such as a theoretical air/fuel ratio, in general. For this purpose, the flow rate of the mixture needs to be controlled at an appropriate value. The flow rate of the mixture can be determined on the basis of a state of the mixture such as a concentration (fuel vapor concentration) of fuel vapor in the mixture. Accordingly, the fuel vapor treatment apparatus includes a unit for determining the fuel state of the mixture.

For example, a fuel vapor treatment apparatus disclosed in JP-A-7-269419 includes an air/fuel ratio sensor provided to the exhaust pipe of the engine for measuring the air/fuel ratio. The fuel vapor concentration indicating the fuel state of the mixture is determined on the basis of the difference between the target air/fuel ratio and the air/fuel ratio measured using the air/fuel ratio sensor.

Volatility of fuel variously changes depending upon a season, a region, and the like. When a fuel injection amount is set without considering discrepancy of a fuel property indicating different volatility, a fuel amount injected into the engine becomes excessive or deficient. Therefore, a unit for determining the fuel property is preferably added to the fuel vapor treatment apparatus. However, it is costly to additionally provide a unit for determining the fuel property.

A generally known leakage detecting apparatus includes a fuel tank and a canister. The leakage detecting apparatus therein defines an enclosed cavity including a space in which fuel vapor is purged into the intake pipe of the engine. The leakage detecting apparatus detects a leaking hole greater than a predetermined size in the enclosed cavity on the basis of change in pressure in the enclosed cavity.

In the leakage detecting apparatus, an erroneous determination may occur when the fuel property is not considered. For example, gas is drawn from the enclosed cavity using a pump of a leakage detecting apparatus. Thereafter, when pressure after a predetermined period is greater than reference value, a leaking hole is determined to exist because of inflow of the external air through the leaking hole. In such an apparatus, when fuel is highly volatile, pressure in the interior of the enclosed cavity is apt to become greater. Accordingly, even when a leaking hole does not exist, the pressure in the enclosed cavity may become greater than the reference value after the predetermined period.

In addition, in an injection control apparatus, the fuel injection amount is preferably controlled by determining the fuel property at low cost.

SUMMARY OF THE INVENTION

The present invention addresses the above disadvantage. According to one aspect of the present invention, a fuel property determining apparatus is provided to a fuel vapor treatment apparatus that controls purging of mixture containing fuel vapor, which is generated in a fuel tank and temporarily adsorbed in a canister, into an intake pipe of an internal combustion engine when the internal combustion engine operates. The fuel vapor treatment apparatus controls the purging on the basis of a fuel vapor state of the mixture. The fuel property determining apparatus includes a fuel vapor state determining unit for determining the fuel vapor state. The fuel property determining apparatus further includes a fuel property determining unit for determining a fuel property, which is relevant to volatility of fuel, on the basis of change in the fuel vapor state. The change in the fuel vapor state is caused by the purging.

According to another aspect of the present invention, a fuel property determining apparatus is provided to a vehicle having a fuel vapor treatment apparatus including a canister for temporarily adsorbing fuel vapor produced in a fuel tank. The fuel vapor treatment apparatus further includes a fuel vapor state determining unit for determining a fuel vapor state of mixture, which contains the fuel vapor purged from the canister. The fuel vapor treatment apparatus controls purging of the fuel vapor, which is temporarily adsorbed in the canister, into an intake pipe of an internal combustion engine when the internal combustion engine operates. The fuel vapor treatment apparatus controls the purging on the basis of the fuel vapor state. The fuel property determining apparatus includes a fuel property determining unit for determining a fuel property relevant to volatility of fuel on the basis of change in the fuel vapor state, the change in the fuel vapor state being caused by purging the mixture from the canister.

According to another aspect of the present invention, a leakage detecting apparatus is provided to a fuel vapor treatment apparatus that controls purging of mixture containing fuel vapor, which is generated in a fuel tank and temporarily adsorbed in a canister, into an intake pipe of an internal combustion engine when the internal combustion engine operates. The fuel vapor treatment apparatus controls the purging on the basis of a fuel vapor concentration of the mixture. The leakage detecting apparatus includes a fuel vapor state determining unit for determining the fuel vapor concentration. The leakage detecting apparatus further includes a fuel property determining unit for determining volatility of fuel on the basis of change in the fuel vapor concentration. The change in the fuel vapor concentration is caused by the purging. The leakage detecting apparatus further includes a leakage detecting unit for detecting a leaking hole, which exists in a closed cavity defined by the fuel tank, the canister, and a passage connecting among the fuel tank, the canister, and the intake pipe. The fuel property determining unit determines fuel to be highly volatile when the change in the fuel vapor concentration is less than a predetermined threshold. The leakage detecting unit detects the leaking hole on the basis of change in pressure in the closed cavity. The leakage detecting unit withholds the detecting when the fuel property determining unit determines the fuel to be highly volatile.

According to another aspect of the present invention, an injection control apparatus is provided to an internal combustion engine having a fuel vapor treatment apparatus that controls purging of mixture containing fuel vapor, which is generated in a fuel tank and temporarily adsorbed in a canister, into an intake pipe of the internal combustion engine when the internal combustion engine operates. The fuel vapor treatment apparatus controls the purging on the basis of a fuel vapor concentration of the mixture. The injection control apparatus includes a fuel vapor state determining unit for determining the fuel vapor concentration. The injection control apparatus further includes a fuel property determining unit for determining a fuel property, which is relevant to volatility of fuel, on the basis of change in the fuel vapor concentration, the change in the fuel vapor concentration being caused by the purging. The injection control apparatus further includes an injection amount determining unit for determining an amount of fuel injected into the internal combustion engine on the basis of the fuel property.

According to another aspect of the present invention, a method for determining fuel property, which is relevant to volatility of fuel, for an internal combustion engine includes temporarily adsorbing mixture containing fuel vapor. The method further includes purging the mixture into an intake pipe of the internal combustion engine when the internal combustion engine operates. The method further includes determining the fuel property on the basis of change in a fuel vapor state during the purging.

According to another aspect of the present invention, a method for detecting leakage in a fuel vapor treatment apparatus for an internal combustion engine includes temporarily adsorbing mixture containing fuel vapor, which is generated in a fuel tank, into a canister. The method further includes purging the mixture into an intake pipe of the internal combustion engine when the internal combustion engine operates. The method further includes determining fuel to be highly volatile when change in a fuel vapor concentration of the mixture during the purging is less than a predetermined threshold. The method further includes defining a closed cavity in the fuel tank, the canister, and a passage connecting among the fuel tank, the canister, and the intake pipe. The method further includes detecting leakage in the closed cavity on the basis of change in pressure in the closed cavity when the fuel is determined to be highly volatile.

According to another aspect of the present invention, a method for controlling fuel injection in an internal combustion engine includes temporarily absorbing mixture containing fuel vapor. The method further includes purging the mixture into an intake pipe of the internal combustion engine when the internal combustion engine operates. The method further includes determining a fuel property, which is relevant to volatility of fuel, on the basis of change in a fuel vapor concentration of the mixture during the purging. The method further includes determining an amount of fuel injected into the internal combustion engine on the basis of the fuel property.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

Embodiment

Figure 1:
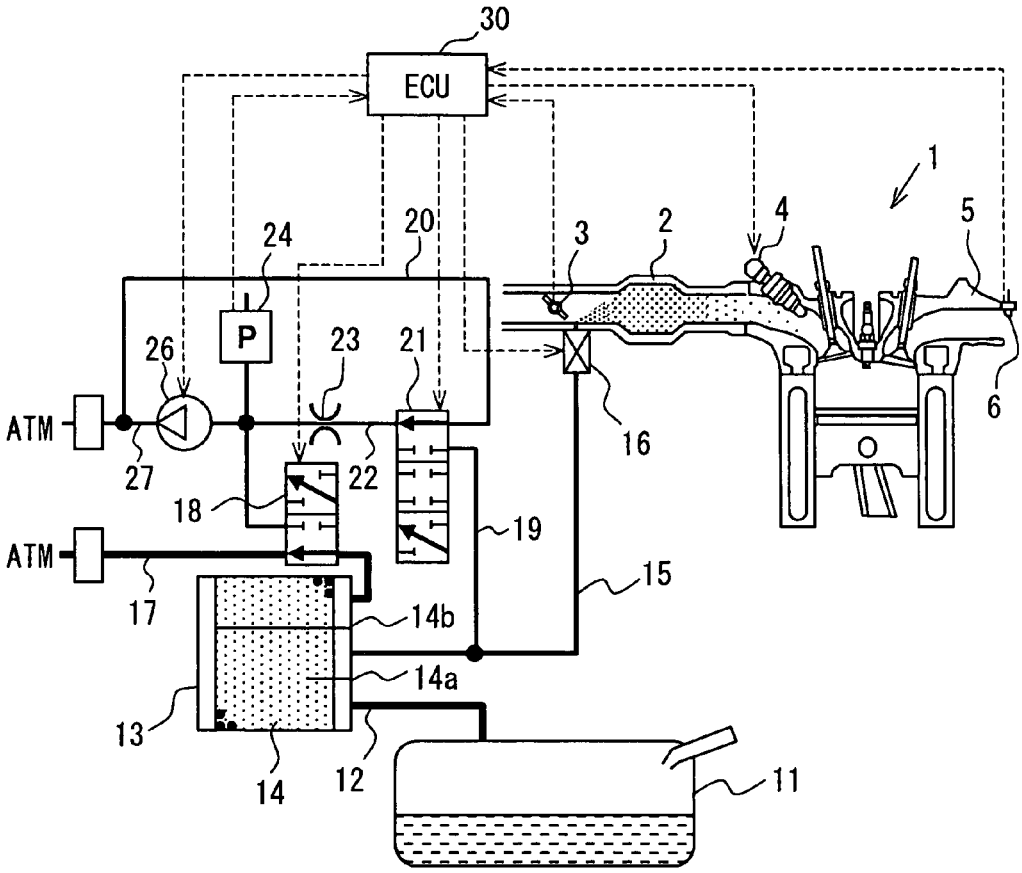
FIG. 1 is a schematic diagram showing a fuel vapor treatment apparatus.

A fuel vapor treatment apparatus in FIG. 1 has functions of a fuel property determining apparatus, a fuel vapor treatment apparatus, a leakage detecting apparatus, and an injection control apparatus. The apparatus in FIG. 1 is provided to, for example, an automobile having an internal combustion engine 1. The engine 1 connects with a fuel tank 11 that regularly communicates with a canister 13 through an evaporation passage 12 defining a vapor introduction passage.

The canister 13 is filled up with an adsorbent 14, which temporarily adsorbs fuel vapor produced in the fuel tank 11. The canister 13 connects with the intake pipe 2 of the engine 1 through a purge passage 15 defining a purge pipe. The purge passage 15 is provided with a purge valve 16 serving as a purge control valve. When the purge valve 16 communicates therein, the canister 13 communicates with the intake pipe 2.

Partition plates 14*a* and 14*b* are provided in the canister 13. The partition plate 14*a* is located between the connection positions of the evaporation passage 12 and the purge passage 15. This partition plate 14*a* restricts the fuel vapor, which is introduced from the evaporation passage 12, from being emitted through the purge passage 15 without being adsorbed into the adsorbent 14.

An atmospheric passage 17 also connects with the canister 13. The other partition plate 14*b* is located between the connection positions of the atmospheric passage 17 and the purge passage 15. The other partition plate 14*b* extends into the adsorbent 14 by depth substantially the same as the depth of the adsorbent 14 filled in the canister 13. Thus, the combustion vapor introduced from the evaporation passage 12 is restricted from being emitted directly through the atmospheric passage 17.

The purge valve 16 is a solenoid valve defining an opening therein. An electronic control unit (ECU) 30 performs various controls of the engine 1. The ECU 30 adjusts the opening defined in the purge valve 16, so as to control the flow rate of mixture, which contains fuel vapor, flowing through the purge passage 15. The mixture controlled in flow rate is purged into the intake pipe 2 by negative pressure in the intake pipe 2 as is controlled using a throttle valve 3. The mixture is combusted together with fuel injected from an injector 4. The mixture, which contains the purged fuel vapor, is termed purge gas.

The atmospheric passage 17 has a tip end opening to the atmosphere through a filter. The atmospheric passage 17 connects with the canister 13. The atmospheric passage 17 is provided with a switching valve 18, which communicates the canister 13 with either one of the atmospheric passage 17 and the suction passage of a pump 26. When the ECU 30 does not operate the switching valve 18, the switching valve 18 is in a first position, in which the switching valve 18 maintains the canister 13 in communication with the atmospheric passage 17. When the ECU 30 operates the switching valve 18 to be in a second position, the switching valve 18 maintains the canister 13 in communication with the suction passage of the pump 26.

A branch passage 19 extends from midway through the purge passage 15. The branch passage 19 connects with one input port of a three-way valve 21. An air feed passage 20 branches from a delivery passage 27 of the pump 26. The delivery passage 27 of the pump 26 opens to the atmosphere through a filter. The air feed passage 20 connects with the other input port of the three-way valve 21. A measurement passage 22 serves as a measurement passage. The measurement passage 22 connects with the output port of the three-way valve 21.

The three-way valve 21 serves as a measurement passage switching unit. The ECU 30 switches the three-way valve 21 to be in any one of a first position, a second position, and a third position. The air feed passage 20 connects with the measurement passage 22 in the first position. The measurement passage 22 is blocked from either one of the air feed passage 20 and the branch passage 19 in the second position. The branch passage 19 connects with the measurement passage 22 in the third position. When the three-way valve 21 is not operated, the three-way valve 21 returns to be in the first position.

The measurement passage 22 is provided with a throttle 23 defined by an orifice, for example. The measurement passage 22 connects with the pump 26, which is a motor pump serving as a gas stream generating unit. The pump 26 draws gas from the throttle 23 through the measurement passage 22 as a suction passage. The ECU 30 turns the pump 26 ON/OFF and controls the rotation speed of the pump 26. When the ECU 30 turns the pump 26 ON, the ECU 30 controls the rotation speed at substantially constant speed, for example, predetermined beforehand.

When the ECU 30 operates the pump 26 in a state where the three-way valve 21 is brought into the first position with the switching valve 18 remaining in the first position, a first measurement state is established. In the first measurement state, the air is drawn through the measurement passage 22.

When the pump 26 is operated with the three-way valve 21 set in the third position, a second measurement state is established. In the second measurement state, mixture containing fuel vapor is fed through the atmospheric passage 17, the canister 13, part of the purge passage 15 up to the branch passage 19, and the branch passage 19, so that the mixture is drawn into the measurement passage 22.

A pressure sensor 24 serves as a pressure measurement unit. One end of the pressure sensor 24 connects with the measurement passage 22 in the downstream of a throttle 23. That is, the pressure sensor 24 is provided between the throttle 23 and the pump 26. The other end of the pressure sensor 24 opens to the atmosphere. The pressure sensor 24 detects differential pressure ΔP between the atmospheric pressure and pressure in the measurement passage 22 in the downstream of the throttle 23. The ECU 30 inputs the differential pressure ΔP measured using the pressure sensor 24.

The throttle valve 3 is provided to the intake pipe 2. The ECU 30 controls the throttle valve 3 to adjust a suction air amount on the basis of detection signals of various sensors. The ECU 30 also controls an amount (fuel injection amount) of fuel injected from the injector 4, the purge valve 16, and the like, on the basis of the detection signals. Specifically, the ECU 30 controls the throttle position, the fuel injection amount, the communication defined in the purge valve 16, and the like, on the basis of, for example, the suction air amount, suction pressure, the air/fuel ratio, an ignition signal, engine speed, engine cooling water temperature, and an accelerator position. The suction air amount is detected using an airflow sensor (not shown) provided to the intake pipe 2. The suction pressure is detected using a suction pressure sensor (not shown). The air/fuel ratio, which is detected using an air/fuel ratio sensor 6 provided to an exhaust pipe 5.

Figure 2:
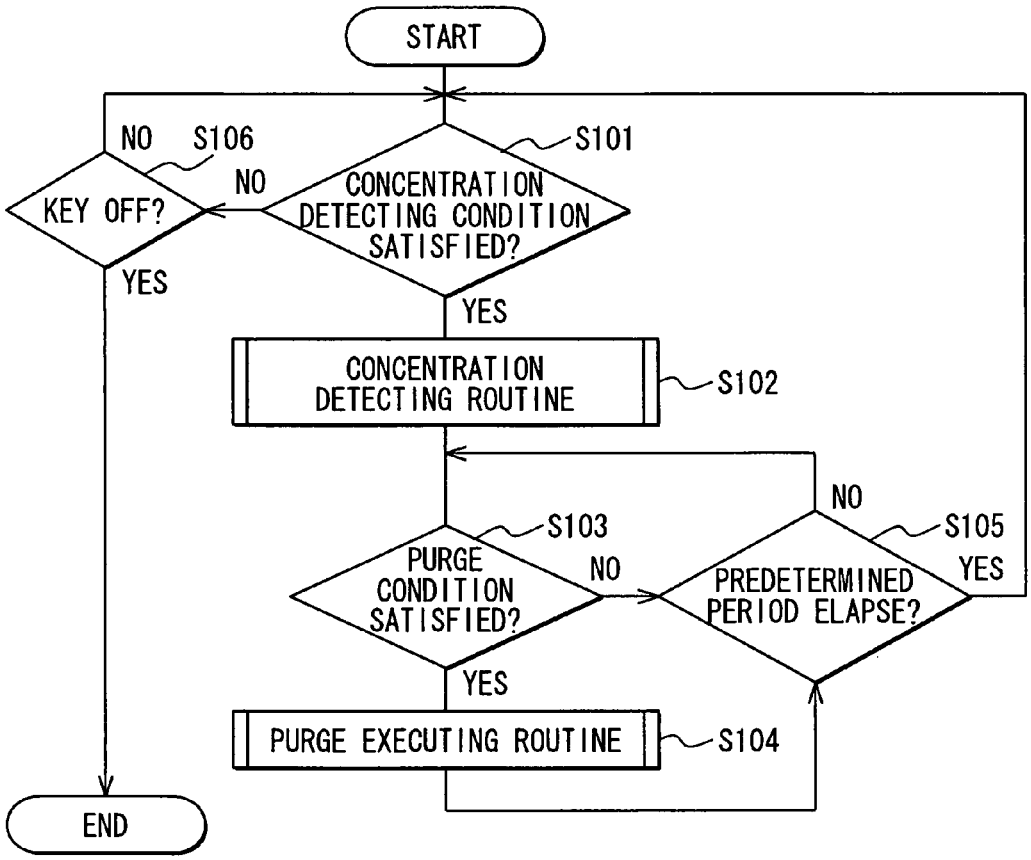
FIG. 2 is a flowchart showing a purge operation of fuel vapor in the fuel vapor treatment apparatus.

The ECU 30 performs a purge operation by executing the flowchart shown in FIG. 2 when the engine 1 starts operation. In step S101, the ECU 30 evaluates whether a concentration detecting condition is satisfied. The concentration detecting condition is satisfied when a state variable, which represents an operating state, such as the engine water temperature, oil temperature, or the engine speed, is in a predetermined range. The concentration detecting condition is satisfied before a purge condition is satisfied. The purge condition is satisfied When a purge operation of fuel vapor can be performed.

Specifically, the purge condition is satisfied when the engine cooling water temperature, for example, becomes equal to or greater than a predetermined value Temp1 so that the ECU 30 determines warming-up of the engine 1 to be completed. The concentration detecting condition is satisfied when the cooling water temperature, for example, becomes equal to or greater than a predetermined value Temp2 set less than the predetermined value Temp1, during the engine warming-up. This concentration detecting condition is satisfied also in a period, in which the purge operation of fuel vapor is stopped during the engine operation, mainly during deceleration of the vehicle. When the fuel vapor treatment apparatus is applied to a hybrid vehicle, the concentration detecting condition may be satisfied also when the hybrid vehicle is kept traveling by a motor with the engine stopped.

When step S101 makes a positive determination, the routine proceeds to step S102, which corresponds to a fuel vapor state determining unit. In step S102, the ECU 30 executes a concentration detecting routine shown in FIG. 3. When step S101 makes a negative determination, the routine proceeds to step S106. In step S106, the ECU 30 evaluates whether an ignition key is turned OFF. When step S106 makes a negative determination, the routine returns to step S101. When the ignition key is turned OFF, the ECU 30 terminates the routine of the purge operation.

Figure 3:
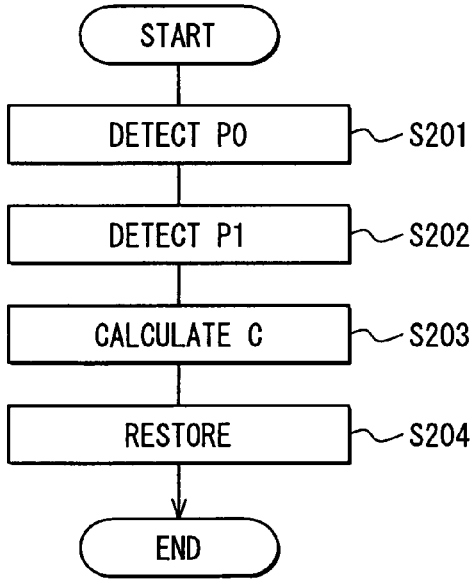
FIG. 3 is a flowchart showing a concentration detecting routine executed in the purge operation.

Before the executing the concentration detecting routine (S102) shown in FIG. 3, the purge valve 16 is blocked, the switching valve 18 is in the first position, in which the canister 13 communicates with the atmospheric passage 17, and the three-way valve 21 is in the first position, in which the air feed passage 20 communicates with the measurement passage 22.

In this initial state, therefore, the pressure detected using the pressure sensor 24 becomes substantially equal to the atmospheric pressure.

In step S201, the pressure sensor 24 detects pressure P0 in a state where air is drawn through the measurement passage 22, as a gas stream. This state corresponds to the first measurement state. The ECU 30 performs measurement of the pressure P0 based on the air stream by operating the pump 26 with maintaining the three-way valve 21 at the first position. In this condition, air is fed into the measurement passage 22 through the air feed passage 20. The upstream of the air feed passage 20 with respect to the throttle 23 is under the same air pressure as at one end of the pressure sensor 24. The other end of the pressure sensor 24 connects to the downstream of the air feed passage 20 with respect to the throttle 23. In this condition, the pressure sensor 24 detects pressure drop caused in air passing through the throttle 23.

Subsequently, in step S202, the pressure sensor 24 detects pressure P1 in a state where mixture containing fuel vapor is drawn through the measurement passage 22, as a gas stream. The ECU 30 performs measurement of the pressure P1 by operating the pump 26 with switching the three-way valve 21 to the third position so that the measurement state becomes in the second measurement state. In this case, mixture containing fuel vapor is fed to the measurement passage 22 after passing through the atmospheric passage 17, the canister 13, the part of the purge passage 15 up to the branch passage 19, and the branch passage 19. That is, the air introduced from the atmospheric passage 17 is drawn through the canister 13, thereby becoming mixture including fuel vapor and the air, and thereafter, this mixture is fed into the measurement passage 22 through the part of the purge passage 15 and the branch passage 19. In the pressure measurement based on the mixture stream, accordingly, the pressure sensor 24 detects pressure drop caused in mixture by passing through the throttle 23 of the measurement passage 22.

In step S203, the ECU 30 calculates a fuel concentration C on the basis of the pressure P0, P1 detected in the respective steps S201, S202. Thereafter, the ECU 30 stores the fuel concentration C.

In the calculation of the fuel concentration C, the ECU 30 calculates the pressure ratio RP between the pressure P0, P1 in accordance with Formula (1), and the ECU 30 calculates the fuel concentration C on the basis of the pressure ratio RP in accordance with Formula (2). In Formula (2), k1 is a constant, which is predetermined by an experiment or the like beforehand.

$$RP = P1 / P0 \tag{1}$$

$$\begin{aligned} C &= k1 \times (RP - 1) \\ &= k1 \times (P1 - P0) / P0) \end{aligned} \tag{2}$$

Fuel vapor is heavier than air. When fuel vapor is contained in the purge gas, the density of the purge gas becomes high. When the rotation speed of the pump 26 is the same and that the flow velocity (flow rate) of the measurement passage 22 is the same, the differential pressure between both the sides of the throttle 23 becomes greater as the density becomes greater, in accordance with the law of energy conservation. Accordingly, as the fuel concentration C becomes greater, the pressure ratio RP becomes greater. The relation between the fuel concentration C and the pressure ratio RP is substantially linear as indicated by Formula (2). The fuel concentration C represents the concentration of the fuel vapor in the purge gas, in terms of a mass ratio.

In the next step S204, the respective portions of the switching valve 18 and the three-way valve 21 are restored to initial states thereof. That is, the switching valve 18 is set in the first position in which the canister 13 communicates with the atmospheric passage 17, and the three-way valve 21 is set in the first position in which the air feed passage 20 communicates with the measurement passage 22.

Referring back to FIG. 2, after executing the concentration detecting routine in step S102, the routine proceeds to step S103 in which the ECU 30 evaluates whether the purge condition is satisfied. The ECU 30 evaluates the purge condition on the basis of the operating state such as the engine water temperature, the oil temperature, or the engine speed, as in a conventional fuel vapor treatment apparatus.

When step S103 makes a positive determination, the ECU 30 executes a purge executing routine in step S104. In the purge executing routine, the ECU 30 calculates the flow rate of the purge gas to be introduced into the intake pipe 2 on the basis of the engine operation state.

Specifically, the ECU 30 calculates the purge gas flow rate on the basis of a request fuel injection amount, a lower-limit value of the fuel injection amount, the pressure in the intake pipe 2, and the like. The request fuel injection amount is an amount of fuel injection, which is required under the current engine operation state corresponding to, such as the throttle position. The lower-limit value of the fuel injection amount corresponds to an amount of fuel injection by which the injector 4 is capable of controlling the fuel injection. The ECU 30 calculates the opening degree defined in the purge valve 16 for controlling the purge gas flow rate on the basis of the fuel vapor concentration C stored in the concentration detecting routine shown in FIG. 3. The ECU 30 controls the opening defined in the purge valve 16 in accordance with the calculated opening degree until a purge stop condition is satisfied.

During a purge period of the purge executing routine, the three-way valve 21 is switched to the first position. Fuel vapor is desorbed from the canister 13, so that mixture containing fuel vapor is purged into the intake pipe 2 through the purge passage 15.

When the ECU 30 completes the purge executing routine in S104, the routine proceeds to step S105. When step S103 makes a negative determination, the routine directly proceeds to step S105. In step S105, the ECU 30 evaluates whether a predetermined period elapses since executing the concentration detecting routine in FIG. 3. When step S105 makes a negative determination, the ECU 30 repeats step S103. When step S105 makes a positive determination, the routine returns to step S101. In this condition, the ECU 30 executes the processing for calculating the fuel vapor concentration C anew, so that the ECU 30 updates the fuel vapor concentration C to the newest value in steps S101, S102. The predetermined period in step S105 is set on the basis of an accuracy of the fuel vapor concentration C in consideration of change in fuel vapor concentration C as time elapses.

Figure 4:
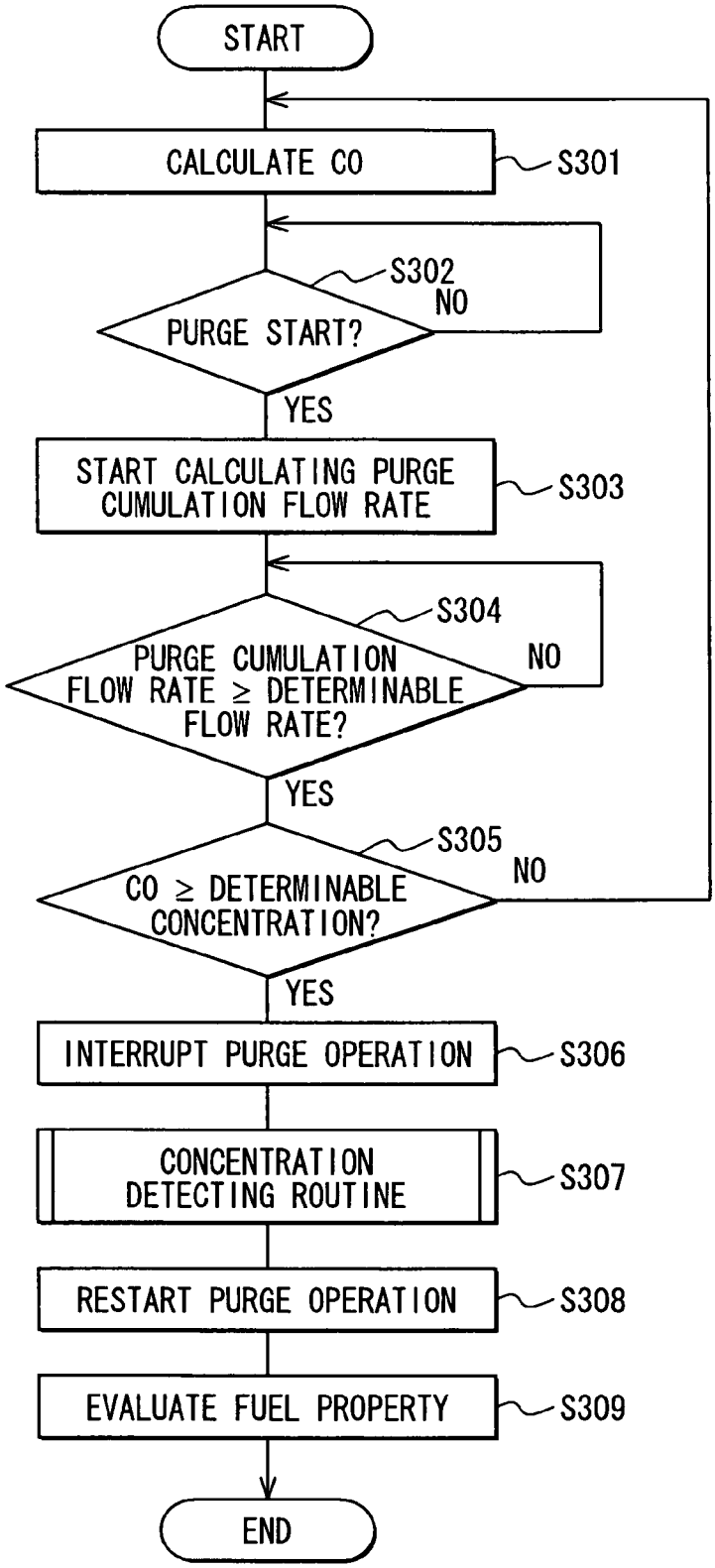
FIG. 4 is a flowchart showing a fuel property determining routine.

As shown in FIG. 4, the ECU 30 repeatedly executes the fuel property determining routine at every predetermined interval for determining volatility of fuel in the fuel tank 11.

First, in step S301, the ECU 30 calculates the fuel vapor concentration C0 in starting engine 1. Specifically, the ECU 30 evaluates the state of an ignition switch for detecting the engine start, after determining that fuel is anew supplied into the fuel tank 11. When the ECU 30 determines that the engine 1 starts, the ECU 30 executes the concentration detecting routine in FIG. 3, whereby the ECU 30 calculates and stores the fuel vapor concentration C0.

In the subsequent step S302, the ECU 30 evaluates whether the ECU 30 starts the purge operation, that is, whether the ECU 30 executes the purge executing routine in step S104 in FIG. 2. When step S302 makes a negative determination, the ECU 30 repeatedly executes this step S302, whereby the ECU 30 stands-by till the ECU 30 starts the purge operation.

When step S302 makes a positive determination, the routine proceeds to step S303 serving as a flow rate determining unit. In step S303, the ECU 30 starts calculating a purge cumulation flow rate by repeating calculation of a purge flow rate (lit./sec.) every second and integrating the purge flow rate, for example.

The ECU 30 calculates the purge flow rate (lit./sec.) per second from the following formula:

Suction air amount (lit./sec.)×Purge rate PGR (%)×
Fuel vapor concentration KPRG (%/purge rate)

Here, the purge rate PGR is the ratio of purge gas to an air amount, by which the mixture is introduced into the intake pipe 2. The purge rate PGR is a target value, which is set on the basis of the engine operation state such as the throttle position and a period after starting the engine. The fuel vapor concentration KPRG is a fuel correction amount to 1% of the purge rate PGR. The difference ΔA/F (%) between the actual air/fuel ratio A/F detected using the air/fuel ratio sensor 6 and a target air/fuel ratio (=14.5) is first evaluated from the following formula (3), so that the fuel vapor concentration KPRG is subsequently evaluated on the basis of the difference ΔA/F by using Formula (4):

$$\Delta A/F(\%)=(((\text{Current } A/F)/14.5)-1)\times 100 \quad (3)$$

$$KPRG=\text{Last value of } KPRG+(\Delta A/F)/PGR \quad (4)$$

The ECU 30 subsequently learns or corrects the fuel injection amount and the suction air amount on the basis of the actual air/fuel ratio ΔA/F detected using the air/fuel ratio sensor 6 when the ECU 30 does not perform the purge operation. Accordingly, the ratio ΔA/F after starting the purge operation is facilitated by starting the purge operation, whereupon the purge gas is purged into the intake pipe 2 through the purge passage 15. Therefore, the ratio ΔA/F can be employed as the fuel vapor concentration. This ratio ΔA/F is sequentially updated at every predetermined interval, for example.

In the subsequent step S304, the ECU 30 evaluates whether the purge cumulation flow rate becomes equal to or greater than a predetermined determinable flow rate.

Figure 5:
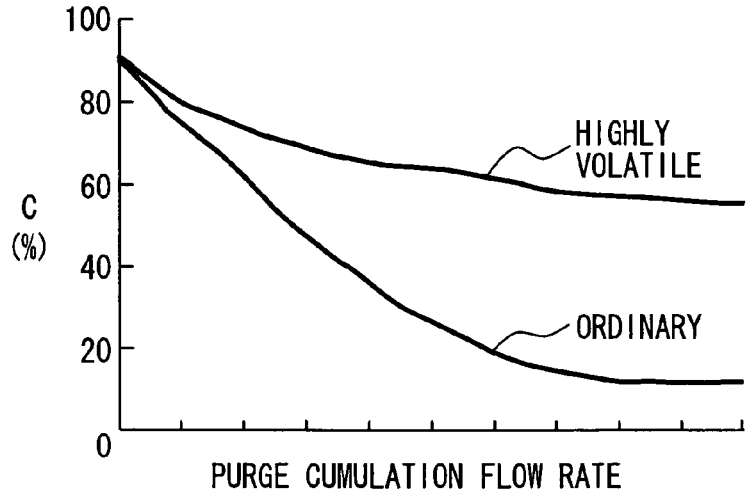
FIG. 5 is a graph showing a relationship between a purge cumulation flow rate and a fuel vapor concentration C.

As shown in FIG. 5, as the purge operation continues, the fuel vapor concentration C gradually decreases. Decrease in fuel vapor concentration C differs depending upon fuel properties. The difference of the fuel vapor concentrations attributed to the different fuel properties is not large at starting of the purge operation. Therefore, the determinable flow rate is set at a value for properly determining the difference of the fuel vapor concentrations attributed to the different fuel properties.

When step S304 makes a negative determination, the ECU 30 repeatedly executes the step S304, so that the ECU 30 stands-by until the purge cumulation flow rate becomes equal to or greater than the determinable flow rate. When step S304 makes a positive determination, the routine proceeds to step S305, in which the ECU 30 further evaluates whether the fuel vapor concentration C0, which is calculated in step S301 in the engine start, is equal to or greater than the predetermined determinable concentration. Step S305 corresponds to a determinability evaluating unit.

When step S305 makes a negative determination, it is difficult to determine the fuel property at a preferable accuracy. Accordingly, the routine returns to step S301 without determining the fuel property in the engine start at this time. In the next start of the engine 1, the ECU 30 recalculates the fuel vapor concentration C0 at that time, and the ECU 30 re-executes step S302 and the following steps.

When the fuel vapor concentration C0 in the engine start is excessively low, the fuel vapor concentration C may not sufficiently decrease in spite of performing the purge operation. As a result, even when the purge cumulation flow rate becomes equal to or greater than the determinable flow rate, the difference of the fuel vapor concentrations attributed to the different fuel properties becomes small. Therefore, the ECU 30 does not determine the fuel property when the fuel vapor concentration C0 in the engine start is less than the determinable concentration in step S305.

By contrast, when step S305 makes a positive determination, the condition is satisfied to determine the fuel property, so that the routine proceeds to step S306. In step S306, the purge valve 16 is temporarily fully blocked, thereby temporarily interrupting the purge operation. In this condition, the fuel injection amount and the suction air amount return to values immediately before the purge operation start.

In step S307, the ECU 30 executes the concentration detecting routine (FIG. 3) to calculate and store the fuel vapor concentration. The fuel vapor concentration at this time is denoted by C1. After the ECU 30 calculates and stores the fuel vapor concentration C1, the routine proceeds to step S308.

In step S308, the ECU 30 restarts the purge operation. Specifically, the ECU 30 reopens the purge valve 16 thereby restoring the suction air amount, and also restores the fuel injection amount to the values immediately before the executing step S306.

In the subsequent step S309, the ECU 30 evaluates the fuel property. Specifically, the ECU 30 evaluates the fuel property by comparing the fuel vapor concentration C1 calculated in step S307 with a concentration threshold Cth set beforehand. When the fuel vapor concentration C1 is equal to or greater than the concentration threshold Cth in step S309, the ECU 30 determines the fuel to be highly volatile. When the fuel vapor concentration C1 is less than the concentration threshold Cth, the ECU 30 determines the fuel to be the ordinary, not being highly volatile. The concentration threshold Cth is less than the determinable concentration in step S305.

The fuel vapor concentration used in the determination of the fuel property in step S309 is an instantaneous value indicating the fuel vapor concentration C1 at the time point. However, the ECU 30 does not execute step S309 unless the fuel vapor concentration C0 in the engine start becomes equal to or greater than the determinable concentration (S305). In step S309, accordingly, the ECU 30 determines the fuel property is on the basis of the change in the fuel vapor concentration C by performing the purge operation.

The ECU 30 terminates the routine after executing step S309.

The above steps S301 to S309 may serve as a fuel property determining unit.

After the ECU 30 determines the fuel property by executing the fuel property determining routine in FIG. 4, the ECU 30 controls the fuel injection amount on the basis of the determined fuel property. More specifically, when the ECU 30 determines the fuel not to be highly volatile, the ECU 30 executes a predetermined normal control. By contrast, when the ECU 30 determines the fuel to be highly volatile, the ECU 30 evaluates whether temperature around the injector and/or temperature in a delivery pipe is greater than a predetermined temperature threshold, in the subsequent engine start. In this condition, the ECU 30 compares, for example, the detection value of an engine water temperature sensor and/or a suction temperature sensor with the predetermined temperature threshold.

When the ECU 30 determines the temperature to be greater than the predetermined temperature threshold, fuel vapor is apt to be produced. In this condition, the ECU 30 increases the fuel injection amount to be greater than the fuel injection amount in the normal control for a predetermined relatively short period after starting the engine. Specifically, the ECU 30 increases the fuel injection amount by extending a fuel injection period, for example. The increase in fuel injection amount may be a predetermined constant amount. Alternatively, the fuel injection amount may be further increased as the temperature becomes greater. Thus, engine controllability can be maintained even when highly volatile fuel is used.

Figure 6:
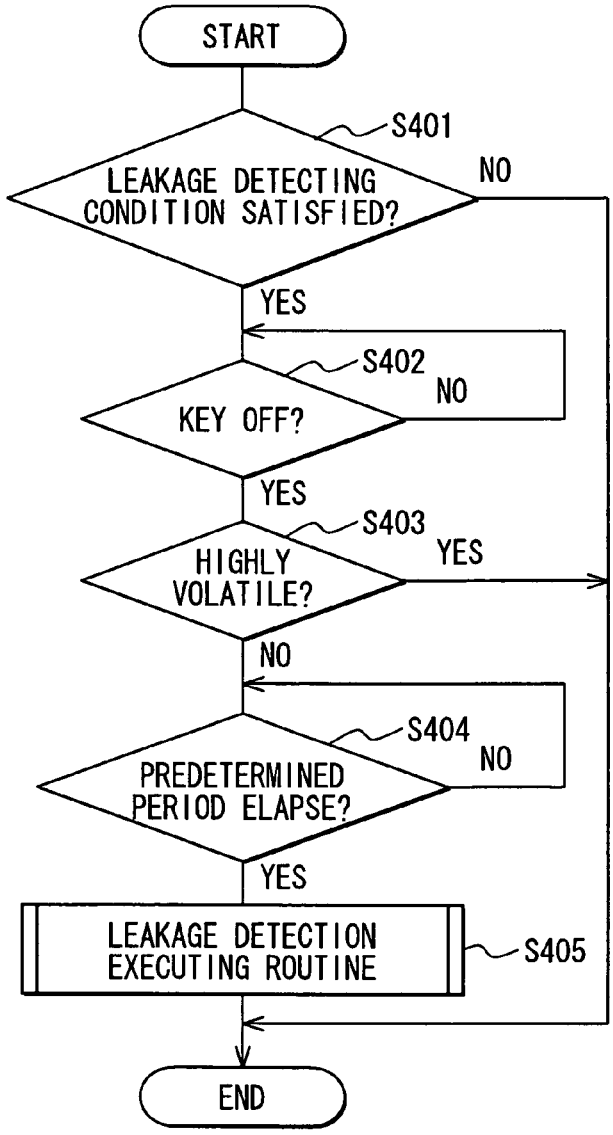
FIG. 6 is a flowchart showing a leakage detection control routine.

Next, a leakage detection control routine is described in reference to FIG. 6. This leakage detection control routine is executed for detecting leaking hole in a purge system. This purge system is a section communicating with the fuel tank 11 when the purge valve 16 is blocked. In this condition, the purge system defines a closed cavity together with the fuel tank 11. The purge system includes the evaporation passage 12, the canister 13, the purge passage 15, the branch passage 19, and the like, in addition to the fuel tank 11.

In step S401, the ECU 30 evaluates whether a leakage detecting condition is satisfied. The leakage detecting condition is satisfied when the vehicle continues running for, at least, a predetermined period, or when the atmospheric temperature is equal to or greater than a predetermined value. When step S401 makes a negative determination, the ECU 30 terminates the routine. By contrast, when step S401 makes a positive determination, the routine proceeds to step S402, in which the ECU 30 evaluates whether the ignition key is OFF. When step S402 makes a negative determination, the ECU 30 repeats this step S402 to wait the ignition key to be turned OFF.

When step S402 makes a positive determination, the routine proceeds to step S403, in which the ECU 30 further evaluates whether the fuel is determined to be highly volatile in accordance with the relationship in FIG. 5. When step S403 makes a positive determination, that is, when the ECU 30 determines the fuel to be highly volatile, the ECU 30 may not accurately perform the leakage detecting operation by leakage detection executing routine. In this condition, therefore, the ECU 30 terminates the routine without executing the leakage detecting operation.

By contrast, when step S403 makes a negative determination, the routine proceeds to step S404, in which the ECU 30 evaluates whether a predetermined period elapses since the key is turned OFF. Immediately after turning the key OFF, the fuel in the fuel tank 11 may be shaking, and/or the fuel temperature may be unstable. In this condition, pressure in the purge system is unstable, and is unsuitable for performing the leakage detecting operation. Therefore, in such a condition in step S404, the ECU 30 withholds performing the leakage detecting operation. The predetermined period is a time period required for stabilizing the state in the purge system from an unstable state immediately after turning the key OFF so that the ECU 30 is capable of accurately performing the leakage detecting operation. When step S404 makes a negative determination, the ECU 30 repeats the step S404. When step S404 makes a positive determination after elapsing the predetermined period, the ECU 30 performs the leakage detecting operation by leakage detection executing routine in step S405, and the ECU 30 terminates the leakage detection control routine.

Figure 7:
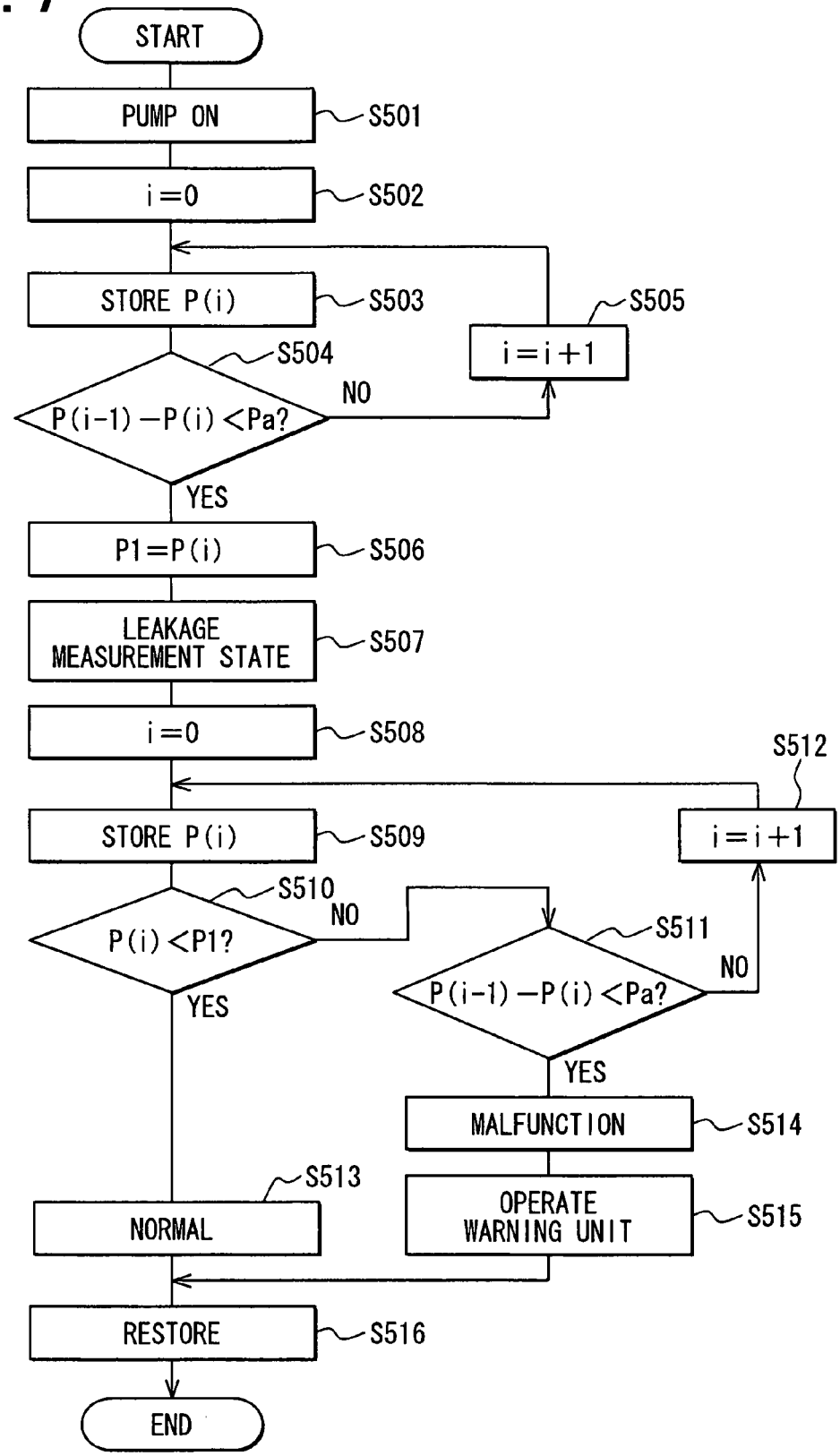
FIG. 7 is a flowchart showing a leakage detection executing routine.

Next, a leakage detection executing routine is described in reference to FIG. 7. At starting of the leakage detection executing routine, the three-way valve 21 is in the first position, and the switching valve 18 is in the first position. In this condition, the pressure detected using the pressure sensor 24, which is the differential pressure sensor, is zero.

Figure 8:
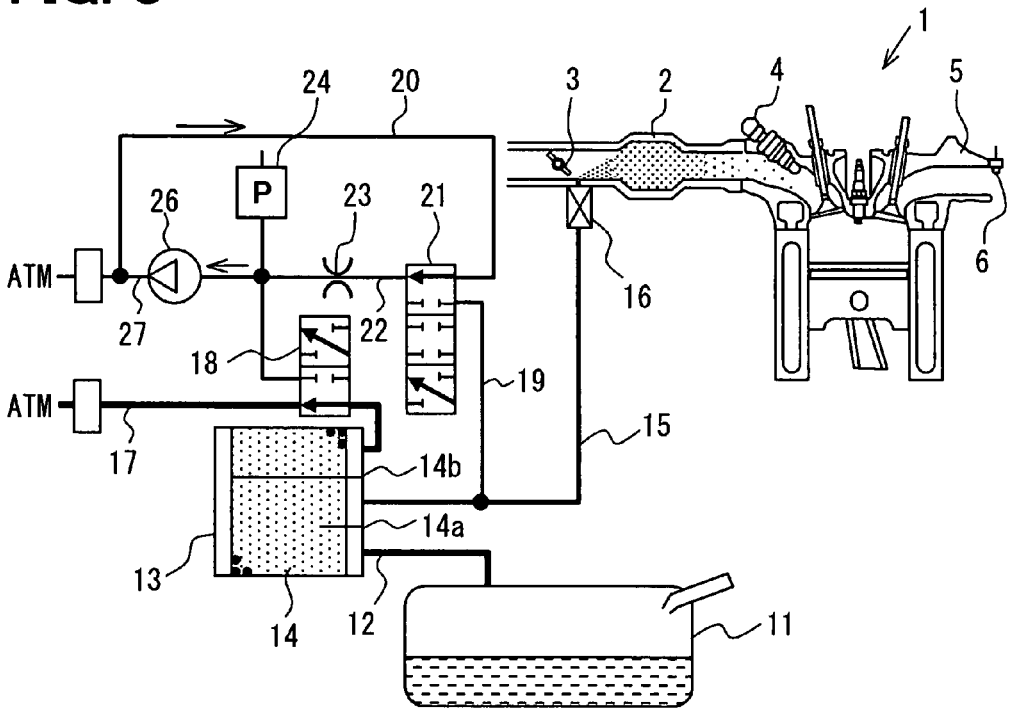
FIG. 8 is a schematic diagram showing the purge system in a gas-circulation state.

In step S501, the ECU 30 turns the pump 26 ON. In this condition, as shown in FIG. 8, the purge system is in a gas-circulation state, which is the same as the first measurement state. In the state of step S501, the three-way valve 21 is in the first position, so that the air feed passage 20 communicating with the atmosphere further communicates with the measurement passage 22. In addition, the switching valve 18 is in the first position, so that the canister 13 is blocked from the pump 26. In this gas-circulation state, air circulates through the measurement passage 22, and the pressure sensor 24 detects pressure drop of air caused by passing through the throttle 23.

In step S502, the ECU 30 sets a variable i at zero. In the subsequent step S503, the ECU 30 stores the pressure (measurement pressure), detected using the pressure sensor 24, as pressure P(i). In step S504, the ECU 30 compares a change [P(i−1)−P(i)] with a threshold Pa so as to evaluate whether [P(i−1)−P(i)] <Pa is satisfied. The change [P(i−1)−P(i)] is a difference between pressure P(i−1) measured immediately before and the pressure P(i) measured at this time.

When step S504 makes a negative determination, the routine proceeds to step S505, in which the ECU 30 increments the variable i by one, and the routine returns to step S503. When step S504 makes a positive determination, the routine proceeds to step S506. In general, the measurement pressure changes greatly in the start-up of the pump 26, and thereafter converges gradually to a pressure value, which is stipulated by the passage cross-sectional area of the throttle 23, and the like. The ECU 30 executes the processing of step S506 and the following steps after the measurement pressure sufficiently converges.

In step S506, the ECU 30 substitutes the pressure P(i) into the reference pressure P1. In step S507, the ECU 30 establish a leakage measurement state.

Figure 9:
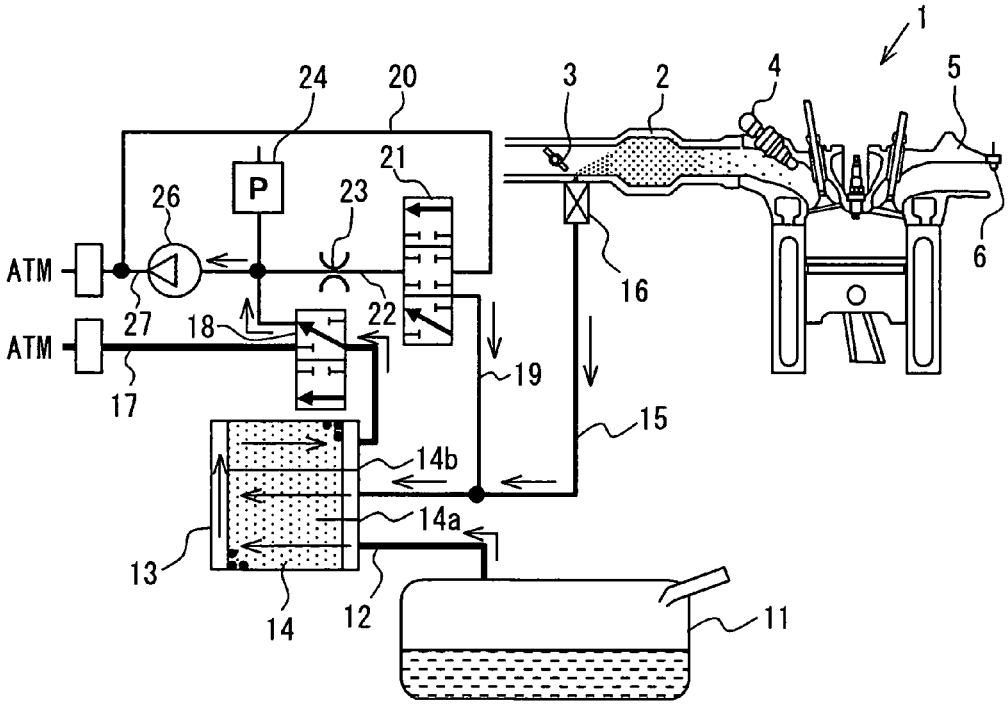
FIG. 9 is a schematic diagram showing the purge system in a leakage measurement state.

As shown in FIG. 9, in this leakage measurement state, the three-way valve 21 is set in the second position, and the switching valve 18 in the second position. In executing a malfunction diagnosis, the ignition key is in the OFF state thereof, so that the purge valve 16 is blocked.

In the leakage measurement state, a closed cavity is defined by the fuel tank 11, the evaporation passage 12, the canister 13, the purge passage 15, the branch passage 19, and a path extending from the canister 13 to the pump 26 via the switching valve 18. Consequently, the pump 26 exhausts gas from the closed cavity to the atmosphere, so that the interior of the closed cavity is reduced in pressure.

In steps S508-S515, the ECU 30 compares the measurement pressure with the reference pressure P1, thereby detecting and evaluating whether any leaking hole exists in the closed cavity.

The pressure, to which the internal pressure in the closed cavity converges in the pressure drop state, is stipulated by an opening area of the throttle 23 when the leaking hole does not exist in the closed cavity. However, when the leaking hole exists in the closed cavity, a perfect closed cavity cannot be defined, and consequently, the pressure does not reach the reference pressure P1. Thus, the ECU 30 evaluates existence of the leaking hole by comparing the measurement pressure with the reference pressure P1.

In step S508, the ECU 30 sets the variable i at zero. In step S509, the ECU 30 stores the pressure P(i), and in step S510, the ECU 30 compares the measurement pressure P(i) with the reference pressure P1 so as to evaluate whether P(i)<P1 is satisfied. When step S510 makes a positive determination, the routine proceeds to step S513. When step S510 makes a negative determination, the routine proceeds to step S511. Immediately after changeover into the leakage measurement state, generally, the measurement pressure P(i) does not reach the reference pressure P1, and step S510 results in a negative determination.

When step S510 makes a negative determination, the routine proceeds to step S511. Steps S511, S512 have the same processing purports as those of the respective steps S504, S505. In step S511, the ECU 30 compares the change [P(i−1)−P(i)] with the threshold Pa so as to evaluate whether [P(i−1)−P(i)]<Pa is satisfied. The change [P(i−1)−P(i)] is the difference between the measurement pressure P(i−1) immediately before and the measurement pressure P(i) at this time. When step S511 makes a negative determination, the routine proceeds to step S512, in which the ECU 30 increments the variable i by one, and the routine returns to step S509. In step S511, the ECU 30 waits the convergence of the measurement pressure P(i) in the same manner as in step S504. When step S511 makes a positive determination, the routine proceeds to step S514.

In step S513, the ECU 30 determines the interior of the closed cavity to be normal. In step S514, the ECU 30 determines that a malfunction occurs in the closed cavity. Specifically, the ECU 30 determines that a leaking hole greater than the throttle 23 exists in the closed cavity, consequently, the ECU 30 determines a malfunction to occur in the closed cavity.

When the ECU 30 determines the closed cavity to be normal in step S513, the routine proceeds to step S516. By contrast, when the ECU 30 determines a malfunction to occur in the closed cavity in step S514, the routine proceed to step S515, in which the ECU 30 operates a warning unit, and subsequently, the routine proceeds to step S516. The warning unit is, for example, an indicator provided on an instrument panel of the vehicle.

In step S516, the pump 26 is turned OFF, and both the three-way valve 21 and the switching valve 18 are set in the first positions, thereby restoring the state assumed before executing the leakage detecting operation.

The fuel vapor concentration C needs to be evaluated in order to determine an opening existing in the purge valve 16 and the like, in performing the purge operation of the fuel vapor. According to this embodiment, in the fuel property determining routine (FIG. 4), the ECU 30 determines the fuel property on the basis of change in the fuel vapor concentration C by performing the purge operation. Accordingly, the fuel property can be determined at cost lower than when a sensor for determining the fuel property is separately provided.

In the above embodiment, the ECU 30 determines the fuel property such as volatility in accordance with the change rate of the fuel vapor state such as the fuel vapor concentration by performing the purge operation. The ECU 30 determines the fuel vapor concentration as the fuel vapor state.

As fuel vapor is purged from the canister into the intake pipe, the fuel vapor state such as the fuel vapor concentration gradually decreases. As fuel becomes highly volatile, the amount of fuel vapor continuously absorbed into the absorbent of the canister before starting and during the purge operation becomes large. Therefore, as fuel becomes highly volatile, decrease in amount of fuel vapor absorbed in the canister by performing the purge operation becomes small.

Therefore, as fuel becomes highly volatile, the change rate of fuel vapor concentration of mixture becomes small. Thus, the fuel property can be determined in accordance with the change rate of the fuel vapor state (fuel vapor concentration) by performing the purge operation. The fuel vapor state determining unit (S102) is inherently included in the fuel vapor treatment apparatus. Therefore, the fuel property can be determined at cost lower than when a sensor for determining the fuel property is separately provided.

As fuel becomes highly volatile, the amount of fuel vapor absorbed in the canister becomes large. As fuel becomes highly volatile, the change rate of the fuel vapor concentration becomes small with respect to the purge cumulation flow rate (FIG. 5). Therefore, as described above, the fuel property can be determined in accordance with the fuel vapor concentration when the purge cumulation flow rate reaches the determinable flow rate.

As described above, the fuel property can be determined in accordance with comparison between the fuel vapor concentration, when the purge cumulation flow rate reaches the determinable flow rate, and the fuel vapor concentration before starting the purge operation. The comparison may be performed on the basis of the difference, the ratio of both the fuel vapor concentrations.

When the fuel vapor concentration is low at starting of the purge operation, decrease in fuel vapor concentration by performing the purge operation becomes small. In this condition, accuracy in determination of fuel vapor may become low. Therefore, as described above, when the fuel vapor concentration is determined low at starting of the purge operation, determination of fuel property can be withheld so that accuracy in determination of fuel vapor can be maintained.

Actually detected or calculated fuel vapor concentration may be employed for evaluating whether the fuel property can be determined. Alternatively, another information relevant to the fuel vapor concentration may be employed for evaluating whether the fuel property can be determined.

When the fuel vapor concentration is already greater than the determinable concentration before starting the purge operation, it is assumed that the fuel vapor concentration is still greater than the determinable concentration at starting of the purge operation even when the fuel vapor concentration is not measured or calculated at starting of the purge operation. Therefore, fuel vapor concentration in the beginning of or before stating the purge operation may be employed for evaluating whether the fuel property can be determined.

Here, as a period, in which the purge operation is not performed, becomes long, the amount of fuel vapor absorbed in the canister increases. Therefore, as this period, in which the purge operation is not performed, becomes long, it is assumed that the fuel vapor concentration at starting of the purge operation to be high. Therefore, it can be evaluated whether the fuel vapor concentration at starting of the purge operation is less than the determinable concentration in accordance with the period, in which the purge operation is not performed.

In the above embodiment, it is determined that fuel is highly volatile when the change rate of the fuel vapor concentration by performing the purge operation is less than the threshold.

When fuel is highly volatile, the change rate of the fuel vapor concentration by performing the purge operation is less than that of ordinary fuel (FIG. 7). Therefore, volatility can be determined in accordance with this change rate of the fuel vapor concentration.

The change rate of the fuel concentration may be calculated from values of the fuel concentration at two time points. Alternatively, as described above, the change rate of fuel vapor concentration at one time point can be determined (S305) by evaluating whether the fuel vapor concentration before starting the purge operation or at starting of the purge operation is greater than the determinable concentration.

The fuel vapor concentration can be determined in accordance with a change rate of pressure (pressure drop) of mixture by passing through the throttle. Alternatively, the fuel vapor concentration can be determined in accordance with the air/fuel ratio.

In the above embodiment, the fuel vapor concentration is determined in accordance with the change rate of pressure (pressure drop) of mixture by passing through the throttle and the change rate of pressure (pressure drop) of air by passing through the throttle.

This determination of the fuel vapor concentration, is described as follows. As generally known as the Bernoulli's principle, the change rate of pressure of fluid passing through a throttle corresponds to the density of the fluid. Therefore, difference of densities between mixture and air can be determined by comparing between the change rate of pressure of mixture, which contains fuel vapor, passing through the throttle and the change rate of pressure of air, which does not contain fuel vapor, passing through the throttle. Here, the change rate of pressure of air passing through the throttle may not be measured or calculated, as appropriate. A predetermined value may be employed instead of this change rate of pressure of air. Alternatively, predetermined value, which is corrected using temperature and pressure, may be employed instead of this change rate of pressure of air. The difference of densities corresponds to the fuel vapor concentration of mixture. Therefore, the fuel vapor concentration of mixture can be determined in accordance with the change rates in pressure of mixture and air.

In the above embodiment, when the fuel is determined to be highly volatile, the leakage detecting operation is withheld. Therefore, existence of leaking hole can be accurately determined.

In the above embodiment, the fuel injection amount is controlled in accordance with the fuel property, so that the amount of fuel supplied into the internal combustion engine can be properly controlled even when the fuel property varies.

Other Embodiment

For example, in the above embodiment, the ECU 30 determines the fuel property by comparing the fuel vapor concentration C1, when the purge cumulation flow rate becomes equal to or greater than the determinable flow rate, with the concentration threshold Cth. The fuel property may be determined on the basis of comparison between the fuel vapor concentration C0 in the engine start before starting the purge operation and the fuel vapor concentration C1 when the purge cumulation flow rate becomes equal to or greater than the determinable flow rate. In this case, for example, the ECU 30 calculates the difference (=C0−C1), the ratio, or the like of both the concentrations, in order to compare these concentrations C0, C1. Subsequently, the ECU 30 evaluates the change in the fuel vapor concentration on the basis of the difference (=C0−C1), the ratio, or the like, and subsequently, the ECU 30 determines the fuel property from the evaluated change in the fuel vapor concentration.

In the above embodiment, the ECU 30 evaluates whether the fuel is highly volatile or ordinary. The ECU 30 may further evaluate whether the fuel is lowly volatile. In the case where the ECU 30 evaluates whether the fuel is lowly volatile, for example, a second concentration threshold Cth2, which is still less than the concentration threshold Cth is set beforehand. When the fuel vapor concentration C1, when the purge cumulation flow rate becomes equal to or greater than the determinable flow rate, is less than the second concentration threshold Cth2, the ECU 30 determines the fuel to be lowly volatile.

The ECU 30 need not regularly employ the fuel vapor concentration C1, when the purge cumulation flow rate becomes equal to or greater than the determinable flow rate, for the determination of the fuel property. For example, as the volatility of the fuel becomes greater, the change rate of the fuel vapor concentration by performing the purge operation becomes smaller, therefore, the ECU 30 may determine the fuel property on the basis of the change rate. Alternatively, the ECU 30 may determine the fuel property on the basis of a period, which is required for the fuel vapor concentration C to reach a predetermined concentration. The ECU 30 may determine the fuel property on the basis of a purge cumulation flow rate when the fuel vapor concentration C reaches the predetermined concentration.

In the above embodiment, when the ECU 30 determines the fuel to be highly volatile, the ECU 30 does not execute the leakage detection. Alternatively, when the ECU 30 determines the fuel to be highly volatile, the ECU 30 may execute the leakage detection by correcting the reference pressure P1 in FIG. 7 such that determining condition of existence of the leaking hole becomes more difficult. For, example, this determining condition may set more difficult by decreasing the absolute value of the reference pressure P1.

In the above embodiment, the ECU 30 calculates the purge flow rate by multiplying the suction air amount detected using the airflow sensor by the purge rate PGR and the fuel vapor concentration KPRG, so that the ECU 30 calculates the purge cumulation flow rate on the basing of the purge flow rate. Alternatively, a flow rate sensor may be provided to the purge passage so as to calculate the purge cumulation flow rate by integrating flow rate, which is sequentially detected using the flow rate sensor.

In the above embodiment, the ECU 30 evaluates whether the fuel property is determinable depending upon whether the fuel vapor concentration C0 in the engine start is equal to or greater than the determinable concentration. Alternatively, the ECU 30 may evaluate whether the fuel property is determinable on the basis of the fuel vapor concentration in the purge operation start, instead of the fuel vapor concentration C0 in the engine start. The fuel vapor concentration in the engine start and the fuel vapor concentration in the purge operation start need not be actually measured. The ECU 30 may estimate these fuel vapor concentrations by calculating on the basis of periods in which the purge operation is not executed.

In the above embodiment, the ECU 30 calculates the fuel vapor concentration C for determining the fuel property on the basis of the pressure drop caused in the purge gas by passing through the throttle 23. Alternatively, the ECU 30 may calculate the fuel property on the basis of the fuel vapor concentration KPRG evaluated from the difference ΔA/F of the air/fuel ratio.

The above processings such as calculations and determinations are not limited being executed by the ECU 30. The control unit may have various structures including the ECU 30 shown as an example.

It should be appreciated that while the processes of the embodiments of the present invention have been described herein as including a specific sequence of steps, further alternative embodiments including various other sequences of these steps and/or additional steps not disclosed herein are intended to be within steps of the present invention.

Various modifications and alternations may be diversely made to the above embodiments without departing from the spirit of the present invention.

What is claimed is:

1. A fuel property determining apparatus for a fuel vapor treatment apparatus that controls purging of mixture containing fuel vapor, which is generated in a fuel tank and temporarily adsorbed in a canister, into an intake pipe of an internal combustion engine when the internal combustion engine operates, the fuel vapor treatment apparatus controlling the purging on the basis of a fuel vapor state of the mixture, the fuel property determining apparatus comprising:

a fuel vapor state determining unit for determining the fuel vapor state; and a fuel property determining unit for determining a fuel property, which is relevant to volatility of fuel, on the basis of change in the fuel vapor state, the change in the fuel vapor state being caused by the purging.

2. The fuel property determining apparatus according to claim 1, wherein the fuel vapor state determining unit determines a fuel vapor concentration of the mixture as the fuel vapor state.

3. The fuel property determining apparatus according to claim 2, further comprising:

a flow rate determining unit for determining a flow rate of the mixture purged from the canister into the intake pipe, wherein the fuel property determining unit determines the fuel property on the basis of the fuel vapor concentration when the flow rate since starting the purging becomes equal to or greater than a determinable flow rate.

4. The fuel property determining apparatus according to claim 2, further comprising:

a flow rate determining unit for determining a flow rate of the mixture purged from the canister into the intake pipe, wherein the fuel property determining unit determines the fuel property on the basis of a comparison between:

the fuel vapor concentration before starting the purging; and the fuel vapor concentration when the flow rate of the mixture since starting of the purging becomes equal to or greater than a determinable flow rate.

5. The fuel property determining apparatus according to claim 2, further comprising:

a determinability evaluating unit for evaluating whether the fuel vapor concentration is less than a predetermined determinable concentration, wherein the fuel property determining unit withholds determining of the fuel property when the determinability evaluating unit determines the fuel vapor concentration at starting of the purging to be less than the determinable concentration.

6. The fuel property determining apparatus according to claim 5, wherein the determinability evaluating unit evaluates the fuel vapor concentration at one of starting of the purging and before starting the purging.

7. The fuel property determining apparatus according to claim 5, wherein the determinability evaluating unit evaluates the fuel vapor concentration on the basis of a period in which the purging is withheld.

8. The fuel property determining apparatus according to claim 2, wherein the fuel property determining unit determines fuel to be highly volatile when the change in the fuel vapor concentration is less than a predetermined threshold.

9. The fuel property determining apparatus according to claim 2, wherein the fuel vapor state determining unit determines the fuel vapor concentration on the basis of:

change in pressure of the mixture, which is purged from the canister, passing through a predetermined throttle; and change in pressure of air passing through the predetermined throttle.

10. The fuel property determining apparatus according to claim 2, further comprising:

an air/fuel ratio sensor provided to an exhaust pipe of the internal combustion engine for measuring an air/fuel ratio, wherein the fuel vapor state determining unit determines the fuel vapor concentration on the basis of difference between a target air/fuel ratio and the air/fuel ratio, which is detected using the air/fuel ratio sensor while the purging.

11. A leakage detecting apparatus for detecting a leaking hole existing in a closed cavity, the leakage detecting apparatus comprising:

the fuel property determining apparatus according to claim 8; and a leakage detecting unit for detecting the leaking hole on the basis of change in pressure in the closed cavity, wherein the closed cavity is defined by the fuel tank, the canister, and a passage connecting the fuel tank, the canister, and the intake pipe, and the leakage detecting unit withholds the detecting when the fuel property determining unit determines the fuel to be highly volatile.

12. An injection control apparatus comprising:

the fuel property determining apparatus according to claim 2; and an injection amount determining unit for determining an amount of fuel injected into the internal combustion engine on the basis of the fuel property.

13. The fuel property determining apparatus according to claim 1, wherein the canister accommodates an absorbent for temporarily absorbing fuel vapor.

14. A fuel property determining apparatus provided to a vehicle having a fuel vapor treatment apparatus including a canister for temporarily adsorbing fuel vapor produced in a fuel tank, the fuel vapor treatment apparatus further including a fuel vapor state determining unit for determining a fuel vapor state of mixture, which contains the fuel vapor purged from the canister, the fuel vapor treatment apparatus controlling purging of the fuel vapor, which is temporarily adsorbed in the canister, into an intake pipe of an internal combustion engine when the internal combustion engine operates, the fuel vapor treatment apparatus controlling the purging on the basis of the fuel vapor state, the fuel property determining apparatus comprising:

a fuel property determining unit for determining a fuel property relevant to volatility of fuel on the basis of change in the fuel vapor state, the change in the fuel vapor state being caused by purging the mixture from the canister.

15. A leakage detecting apparatus for a fuel vapor treatment apparatus that controls purging of mixture containing fuel vapor, which is generated in a fuel tank and temporarily adsorbed in a canister, into an intake pipe of an internal combustion engine when the internal combustion engine operates, the fuel vapor treatment apparatus controlling the purging on the basis of a fuel vapor concentration of the mixture, the leakage detecting apparatus comprising:

a fuel vapor state determining unit for determining the fuel vapor concentration;

a fuel property determining unit for determining volatility of fuel on the basis of change in the fuel vapor concentration, the change in the fuel vapor concentration being caused by the purging; and a leakage detecting unit for detecting a leaking hole, which exists in a closed cavity defined by the fuel tank, the canister, and a passage connecting among the fuel tank, the canister, and the intake pipe, wherein the fuel property determining unit determines fuel to be highly volatile when the change in the fuel vapor concentration is less than a predetermined threshold, the leakage detecting unit detects the leaking hole on the basis of change in pressure in the closed cavity, and the leakage detecting unit withholds the detecting when the fuel property determining unit determines the fuel to be highly volatile.

16. An injection control apparatus for an internal combustion engine having a fuel vapor treatment apparatus that controls purging of mixture containing fuel vapor, which is generated in a fuel tank and temporarily adsorbed in a canister, into an intake pipe of the internal combustion engine when the internal combustion engine operates, the fuel vapor treatment apparatus controlling the purging on the basis of a fuel vapor concentration of the mixture, the injection control apparatus comprising:

a fuel vapor state determining unit for determining the fuel vapor concentration;

a fuel property determining unit for determining a fuel property, which is relevant to volatility of fuel, on the basis of change in the fuel vapor concentration, the change in the fuel vapor concentration being caused by the purging; and an injection amount determining unit for determining an amount of fuel injected into the internal combustion engine on the basis of the fuel property.

17. A method for determining fuel property, which is relevant to volatility of fuel, for an internal combustion engine, the method comprising:

temporarily adsorbing mixture containing fuel vapor;

purging the mixture into an intake pipe of the internal combustion engine when the internal combustion engine operates; and determining the fuel property on the basis of change in a fuel vapor state during the purging.

18. A method for detecting leakage in a fuel vapor treatment apparatus for an internal combustion engine, the method comprising:

temporarily adsorbing mixture containing fuel vapor, which is generated in a fuel tank, into a canister;

purging the mixture into an intake pipe of the internal combustion engine when the internal combustion engine operates;

determining fuel to be highly volatile when change in a fuel vapor concentration of the mixture during the purging is less than a predetermined threshold;

defining a closed cavity in the fuel tank, the canister, and a passage connecting among the fuel tank, the canister, and the intake pipe; and detecting leakage in the closed cavity on the basis of change in pressure in the closed cavity when the fuel is determined to be highly volatile.

19. A method for controlling fuel injection in an internal combustion engine, the method comprising:

temporarily absorbing mixture containing fuel vapor;

purging the mixture into an intake pipe of the internal combustion engine when the internal combustion engine operates;

determining a fuel property, which is relevant to volatility of fuel, on the basis of change in a fuel vapor concentration of the mixture during the purging; and determining an amount of fuel injected into the internal combustion engine on the basis of the fuel property.

20. The fuel property determining apparatus according to claim 14, wherein the fuel property determining unit determines said fuel property to be a fuel which is highly volatile when the change in the fuel vapor state caused by the purging is less than a predetermined threshold.

21. The injection control apparatus according to claim 16, wherein the fuel property determining unit determines said fuel property to be a fuel which is highly volatile when the change in the fuel vapor concentration caused by the purging is less than a predetermined threshold.

22. The method according to claim 17, wherein the determined fuel property is a fuel which is highly volatile when the change in the fuel vapor state during the purging is less than a predetermined threshold.

23. The method according to claim 19, wherein the determined fuel property is a fuel which is highly volatile when the change in the fuel vapor concentration during the purging is less than a predetermined threshold.

* * * * *